US012781467B2

(12) United States Patent
Borgstadt

(10) Patent No.: US 12,781,467 B2
(45) Date of Patent: Nov. 3, 2026

(54) WORK MACHINE AND METHOD FOR OBJECT DETECTION INCLUDING IDENTIFYING AND IGNORING A MOVEABLE WORK IMPLEMENT

(71) Applicant: Deere & Company, Moline, IL (US)

(72) Inventor: Justin A. Borgstadt, West Des Moines, IA (US)

(73) Assignee: Deere & Company, Moline, IL (US)

( * ) Notice: Subject to any disclaimer, the term of this patent is extended or adjusted under 35 U.S.C. 154(b) by 283 days.

(21) Appl. No.: 18/607,775

(22) Filed: Mar. 18, 2024

(65) Prior Publication Data

US 2025/0290284 A1 Sep. 18, 2025

(51) Int. Cl.
*E02F 9/20* (2006.01)
*E02F 9/24* (2006.01)
(Continued)

(52) U.S. Cl.
CPC ..... *E02F 9/2033* (2013.01); *E02F 9/245* (2013.01); *E02F 9/265* (2013.01); *E02F 3/7609* (2013.01); *E02F 5/32* (2013.01)

(58) Field of Classification Search
CPC ..... E02F 3/7609; E02F 9/262; E02F 9/2033; E02F 5/32; E02F 9/24; E02F 9/245; E02F 9/265
(Continued)

(56) References Cited

U.S. PATENT DOCUMENTS 6,282,317 B1 8/2001 Luo et al.
7,035,461 B2 4/2006 Luo et al.
(Continued)

FOREIGN PATENT DOCUMENTS

AU 2025201030 A1 * 10/2025 ..... E02F 9/265
CN 104732518 A * 6/2015 ..... G01C 21/00
(Continued)

OTHER PUBLICATIONS

Jo, B., Y. Lee, J. Kim, D. Kim, and P. Choi. Proximity warning and excavator control system for prevention of collision accidents. Sustainability, 9 (8), 1488 . . . (Year: 2017).*
(Continued)

*Primary Examiner* — Cuong H Nguyen
(74) *Attorney, Agent, or Firm* — Gary L. Montle; Lucian Wayne Beavers; Patterson Intellectual Property Law, PC

(57) ABSTRACT

A work method and method provide intervention feedback based on spatially proximate objects in a work area. The work machine includes perception sensors and a work implement. During a calibration stage, the implement is moved to various positions across an available range of movement, and depth data are provided for each position and for each of various perception field portions with respect to objects within a perception field. For each position, a multidimensional manifold is created and stored comprising depth data associated with the work implement for the perception field portions including the work implement. During a machine operation stage, further perception inputs are used to determine current depth data for the perception field portions, and feedback signals are conditionally generated corresponding to an intervention event state which is determined while ignoring any objects identified as corresponding to the multidimensional manifold corresponding to a current position of the work implement.

20 Claims, 5 Drawing Sheets

(51) Int. Cl.
*E02F 9/26* (2006.01)
*E02F 3/76* (2006.01)
*E02F 5/32* (2006.01)

(58) Field of Classification Search
USPC ..... 701/50
See application file for complete search history.

(56) References Cited

U.S. PATENT DOCUMENTS

| | | | | |
|---|---|---|---|---|
| 7,680,340 | B2 | 3/2010 | Luo et al. | |
| 7,860,320 | B2 | 12/2010 | Luo et al. | |
| 8,520,897 | B2 | 8/2013 | Boncyk et al. | |
| 8,965,104 | B1 | 2/2015 | Hickman et al. | |
| 9,233,710 | B2 | 1/2016 | Lavoie et al. | |
| 9,493,187 | B2 | 11/2016 | Pilutti et al. | |
| 9,598,036 | B2 | 3/2017 | Lim et al. | |
| 10,214,239 | B2 | 2/2019 | Lee et al. | |
| 10,344,450 | B2 | 7/2019 | Sharp et al. | |
| 10,453,165 | B1 | 10/2019 | Kostov et al. | |
| 10,474,926 | B1 | 11/2019 | Dirac et al. | |
| 10,583,832 | B2 | 3/2020 | Foster et al. | |
| 10,762,605 | B2 | 9/2020 | Chui et al. | |
| 10,829,911 | B2 | 11/2020 | Kennedy et al. | |
| 12,442,158 | B1 * | 10/2025 | Sadilek | E02F 9/26 |
| 2014/0354813 | A1 | 12/2014 | Ishimoto | |
| 2018/0101235 | A1 * | 4/2018 | Bodensteiner | H04W 4/021 |
| 2018/0309962 | A1 | 10/2018 | Shimizu | |
| 2019/0100139 | A1 | 4/2019 | Koravadi | |
| 2019/0347498 | A1 | 11/2019 | Herman et al. | |
| 2020/0238921 | A1 | 7/2020 | Matsuba et al. | |
| 2021/0221363 | A1 | 7/2021 | Lai et al. | |
| 2021/0287459 | A1 * | 9/2021 | Cella | G07C 5/0808 |
| 2022/0105633 | A1 * | 4/2022 | Stoeffler | B25J 19/06 |
| 2022/0105634 | A1 * | 4/2022 | Oboril | B25J 9/163 |
| 2022/0105635 | A1 * | 4/2022 | Chin | B25J 9/163 |
| 2022/0163959 | A1 * | 5/2022 | Cella | G06Q 30/06 |
| 2022/0193915 | A1 * | 6/2022 | Marinkovich | G05D 1/0297 |
| 2022/0379474 | A1 * | 12/2022 | Vu | G06T 17/10 |
| 2023/0038266 | A1 * | 2/2023 | Kean | E02F 9/264 |
| 2023/0133175 | A1 * | 5/2023 | Czarnecki | G06T 7/11 701/301 |
| 2023/0375343 | A1 * | 11/2023 | Martin | G01C 11/06 |
| 2023/0390932 | A1 * | 12/2023 | Greenberg | B25J 13/08 |
| 2025/0207365 | A1 * | 6/2025 | Hanson | E02F 9/26 |

FOREIGN PATENT DOCUMENTS

| | | | | |
|---|---|---|---|---|
| CN | 117168470 | A * | 12/2023 | G01C 21/00 |
| DE | 102022209351 | A1 * | 5/2023 | E02F 9/265 |
| EP | 4621143 | A1 * | 9/2025 | E02F 9/265 |

OTHER PUBLICATIONS

DE-102022209351-A1 by Czarnecki Nathaniel M. (an English translated version) (Year: 2023).*

CN-117168470-A by Faw Nanjing University (an English translated version) (Year: 2023).*

Merangolo, Maria Francesca. An abstract of Sensor Fusion for Autonomous Driving. Diss. Politecnico di Torino, 2025. (Year: 2025).*

Al-Shameri, Mohammed Ali Abdulrahman, and Arfan Ail Mohammed Qasam. An abstract of "A review paper on Intelligent control systems to improve the speed of the robotic arm for picking fruit." International Journal of Research in Engineering and Science (IJRES) 6.7 (2024): 40-45. (Year: 2024).*

Sun, Qihao, Changcheng Yin, and Baohua Wang. An abstract of "The application of neural networks driven by nonlinear model data in road roughness estimation." Measurement Science and Technology 36.2 (2025): 026004. (Year: 2025).*

Pastrana, Omar Alejandro Valdez. An abstract of Digital Twin Application With Convolutional Neural Networks for Enhanced Monitoring and Control in Additive Manufacturing. MS thesis. New Mexico State University, 2024. (Year: 2024).*

Extended European Search Report and Written Opinion issued in European Patent Application No. 25157727.6 dated Jul. 4, 2025, in 06 pages.

* cited by examiner

WORK MACHINE AND METHOD FOR OBJECT DETECTION INCLUDING IDENTIFYING AND IGNORING A MOVEABLE WORK IMPLEMENT

FIELD OF THE DISCLOSURE

The present disclosure relates generally to work machines which include work implements mounted thereon, and to methods of detecting and classifying objects in a proximity thereof. More particularly, but not by way of limitation, the present disclosure relates to object detection systems and methods for ignoring the presence of the work implements in a perception field in order to separate and favorably distinguish external objects.

BACKGROUND

Conventional methods are known for detecting objects in the rear of a work machine or equivalent vehicle, for example including camera-based perception systems which use image data to identify and detect obstacles such as people, vehicles, buildings, etc., to provide feedback to the operator and bystanders in the vicinity. This feedback can be visual and/or audio alerts or braking the vehicle to avoid collisions. However, such systems and methods typically are only functional when there are no vehicle components protruding into the field of view for associated sensors. As but one example, an automotive rear parking sensor becomes non-functional when there is a bike rack or trailer attached to the hitch, therefore prompting the driver to turn off the system as it cannot differentiate the vehicle attachments from obstacles behind the vehicle.

Certain types of work machines such as construction equipment and agricultural equipment use work implements for various types of work, such as rippers on dozers, articulated buckets on loaders, tillage tools on tractors, and the like. In general, these work implements are visible and accordingly detected within the perception system operational area, but issuing alerts for these work implements is of course undesirable.

Work machines as the primary subject of the present disclosure may for example include self-propelled vehicles such as dozers, compact track loaders, excavator machines, skid steer loaders, and the like which grade or otherwise modify the terrain or equivalent working environment in some way. However, the scope of the present disclosure further extends to work machines that are not self-propelled.

BRIEF SUMMARY

The current disclosure provides an enhancement to conventional systems and methods, at least in part by ignoring an implement in the operational space of a perception system while minimizing the loss of usable data. This feature may be provided in part by identifying and differentiating objects proximate to work implements, without "false positive" detection of the work implements themselves. Such a system and method may desirably assist operators in maintaining situational awareness around the work implement, even throughout movement of the work machine and/or of the work implements relative to the main frame of the work machine.

In one exemplary embodiment as disclosed herein, a method is provided for generating intervention feedback based on objects in a work area with a work machine, the work machine having one or more perception sensors and a work implement associated therewith, and the work implement having an available range of movement relative to a frame of the work machine which at least partially extends into a perception field associated with the one or more perception sensors. During a calibration stage of the method, the work implement may be moved to a plurality of positions corresponding to the available range of movement, and via input from at least the one or more perception sensors, and with respect to each of the plurality of positions, depth data are determined for each of a plurality of perception field portions with respect to objects identified within the perception field. For each of the plurality of positions, based at least in part on identified changes in the depth data with sequential positions of the work implement, the method includes generating a multidimensional manifold in data storage comprising depth data associated with the work implement for the plurality of perception field portions including the work implement. During a machine operation stage, the method includes determining, via input from at least the one or more perception sensors, current depth data for each of a plurality of perception field portions with respect to objects identified within the perception field, and further determining an intervention event state based on the objects identified within the perception field, further disregarding any objects identified as corresponding to the multidimensional manifold corresponding to a current position of the work implement. Feedback signals may be conditionally generated corresponding to the determined intervention event state.

In one exemplary and optional aspect according to the above-referenced method embodiment, the feedback signals may be provided in accordance with at least one intervention event state to a work machine controller for controlling one or more components of the work machine to avoid one or more of the objects identified within the perception field.

In another exemplary and optional aspect according to the above-referenced method embodiment, the feedback signals may be provided in accordance with at least one intervention event state to generate audio and/or visual alerts based at least in part on a spatial proximity of one or more of the objects identified within the perception field with respect to the work machine.

In another exemplary and optional aspect according to the above-referenced method embodiment, at least one intervention alert state may be triggered by at least one of the one or more objects being nearer to the frame of the work machine than the work implement within a common perception field portion.

In another exemplary and optional aspect according to the above-referenced method embodiment, at least one intervention alert state may be triggered by at least one of the one or more objects being within a corresponding threshold. For example, a plurality of intervention alert states may be respectively dependent on a travel speed of the work machine and a distance separating the at least one of the one or more objects from the work machine and/or work implement.

In another exemplary and optional aspect according to the above-referenced method embodiment, each of the perception field portions may correspond to respective pixels in a field of view for a perception sensor.

In another exemplary and optional aspect according to the above-referenced method embodiment, the multidimensional manifold may be generated for at least a first of the plurality of positions using a stored model specifying a structure for the work implement. For example, the calibration state may comprise, for each subsequent position after the first position, predicting depth values for one or more perception field portions as corresponding to the work implement, and verifying the stored model based on captured depth values at the respective one or more perception field portions.

In another embodiment as disclosed herein, a work machine is configured to generate intervention feedback based on objects in a work area, and comprises one or more perception sensors, a work implement having an available range of movement relative to a frame of the work machine which at least partially extends into a perception field associated with the one or more perception sensors, and one or more processors functionally linked to the one or more perception sensors and one or more actuators associated with the work implement. The one or more processors are configured to direct the performance of operations according to the above-referenced method embodiment and optionally one or more of the aspects thereof.

In one further exemplary aspect according to the above-referenced work machine embodiment, one or more position sensors may be mounted in association with the work implement and/or an actuator thereof, wherein the data storage comprises a retrievable table correlating position sensor outputs corresponding to work implement positions with depth values from the one or more perception sensors.

In another further exemplary aspect according to the above-referenced work machine embodiment, the one or more perception sensors may comprise at least one perception sensor having a field of view comprising a plurality of pixels corresponding to the plurality of perception field portions, wherein the depth data is generated based at least in part on outputs from at least one other perception sensor.

In other exemplary embodiments, a system including one or more processors may at least partially include a remote server-based platform, wherein operations according to the above-referenced method embodiment and optionally one or more of the aspects thereof may be at least partially performed using at least one processor associated with the remote server-based platform. The server-based platform in examples of such embodiments may coordinate with a controller associated with the work machine for performance of one or more operations.

Numerous objects, features and advantages of the embodiments set forth herein will be readily apparent to those skilled in the art upon reading of the following disclosure when taken in conjunction with the accompanying drawings.

DETAILED DESCRIPTION

Figure 1:
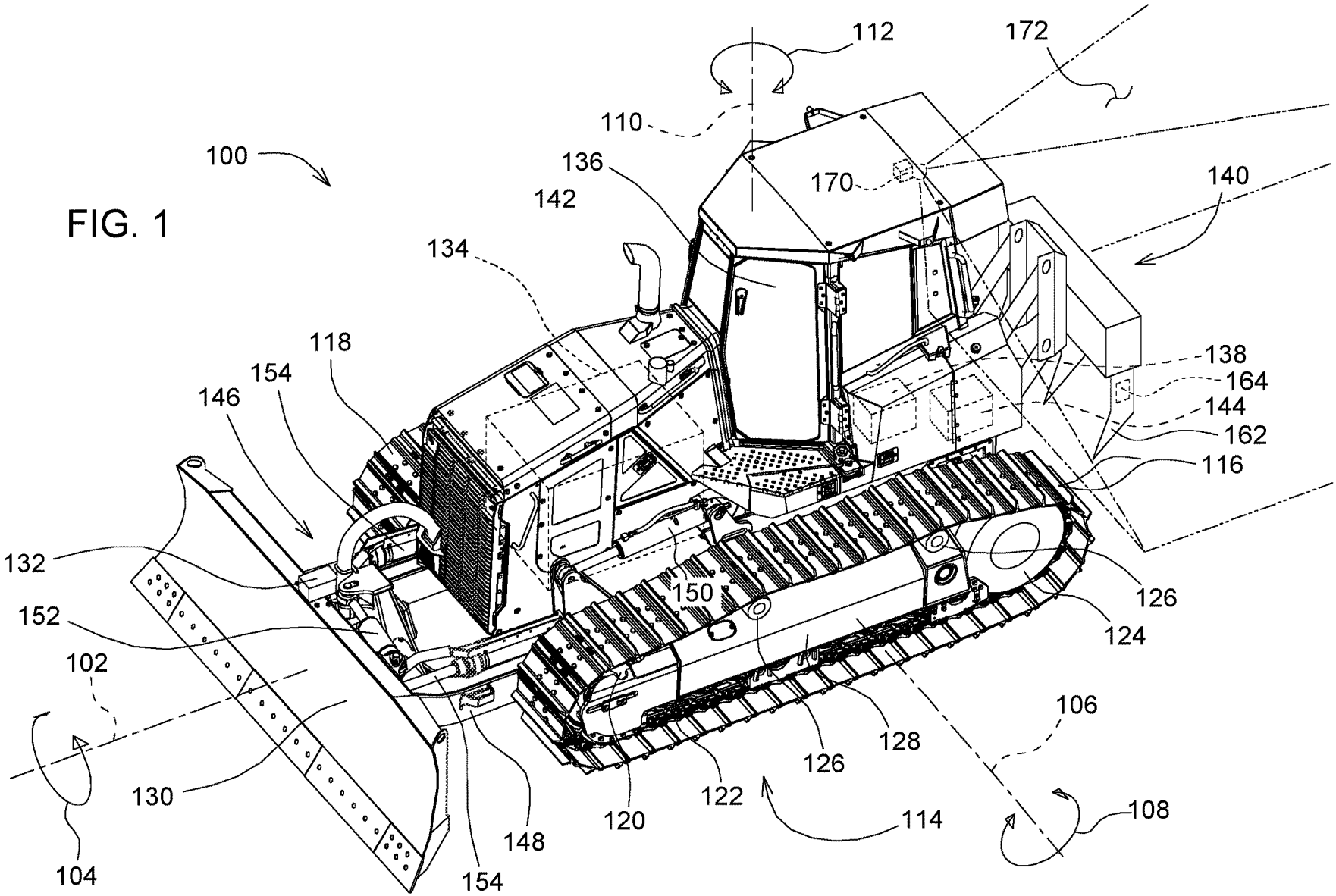
FIG. 1 is a perspective view of a tracked work machine incorporating an embodiment of a work machine and method as disclosed herein.

FIG. 1 is a perspective view of an exemplary work machine 100. In the illustrated embodiment, the work machine 100 is a crawler dozer having a front-mounted work implement 130 (e.g., ground-engaging blade) and a rear-mounted work implement 162 (e.g., ripper), but may include any of various alternative implement configurations (e.g., rear only) or work machines 100 such as a compact track loader, motor grader, scraper, skid steer, backhoe, and tractor, to name but a few examples. While operating, the work machine may experience movement in three directions and rotation in three directions. A direction for the work machine may also be referred to with regard to a longitudinal direction 102, a latitudinal or lateral direction 106, and a vertical direction 110. Rotation for work machine 100 may be referred to as roll 104 or the roll direction, pitch 108 or the pitch direction, and yaw 112 or the yaw direction or heading.

An operator's cab 136 may be located on the main frame 140. The operator's cab and a front-mounted working implement 130 may both be mounted on the main frame 140 so that at least in certain embodiments the operator's cab faces in the working direction of the working implement 130. A control station including a user interface 142 with a display unit may be located in the operator's cab 136. As used herein, directions with regard to work machine 100 may be referred to from the perspective of an operator seated within the operator cab 136: the left of work machine is to the left of such an operator, the right of work machine is to the right of such an operator, the front or fore of work machine 100 is the direction such an operator faces, the rear or aft of work machine is behind such an operator, the top of work machine is above such an operator, and the bottom of work machine is below such an operator.

The term "user interface" 142 as used herein may broadly take the form of a display unit and/or other outputs from the system such as indicator lights, audible alerts, and the like. The user interface may further or alternatively include various controls or user inputs (e.g., a steering wheel, joysticks, levers, buttons) for operating the work machine 100, including operation of the engine, hydraulic cylinders, and the like. Such an onboard user interface may be coupled to a vehicle control system, via for example a CAN bus arrangement or other equivalent forms of electrical and/or electro-mechanical signal transmission. Another form of user interface (not shown) may take the form of a display unit (not shown) that is generated on a remote (i.e., not onboard) computing device, which may display outputs such as status indications and/or otherwise enable user interaction such as the providing of inputs to the system. In the context of a remote user interface, data transmission between for example the vehicle control system and the user interface may take the form of a wireless communications system and associated components as are conventionally known in the art.

The illustrated work machine 100 further includes a control system 180 including a controller 138 (further described below with respect to FIG. 2). The controller 138 may be part of the machine control system of the work machine, or it may be a separate control module. Accordingly, the controller 138 may generate control signals for controlling the operation of various actuators throughout the work machine 100, which may for example be hydraulic motors, hydraulic piston-cylinder units, electric actuators, or the like. Electronic control signals from the controller may for example be received by electro-hydraulic control valves associated with respective actuators, wherein the electro-hydraulic control valves control the flow of hydraulic fluid to and from the respective hydraulic actuators to control the actuation thereof in response to the control signal from the controller.

The controller 138 may include or be functionally linked to the user interface 142 and optionally be mounted in the operators cab 136 at a control panel.

The controller 138 is configured to receive input signals from some or all of various sensors associated with the work machine 100, which may include for example one or more sensors 132 associated with a front-mounted work implement 130, a set of one or more sensors 144 affixed to the main frame 140 of the work machine 100 and configured to provide signals indicative of, e.g., an inclination (slope) of the main frame or the blade, and a set of one or more sensors 164 affixed to for example a rear-mounted work implement 162 and configured to provide signals indicative of a relative position thereof. In alternative embodiments, such sensors 132, 144, 164 may not be affixed directly to the referenced components but may instead be connected indirectly through intermediate components or structures, such as rubberized mounts. For example, sensor 144 may not be directly affixed to the main frame 140 but still connected to the frame at a fixed relative position so as to experience the same motion as the main frame. As another example, sensors 132 and/or 164 may be affixed to actuators associated with controlled movement of the respective work implements 130, 162, and configured thereby to provide output signals representative of the positions of these implements 130, 162 relative to the main frame 140.

The sensor(s) 144 may be configured to provide at least a signal indicative of the inclination of the main frame 140 relative to the direction of gravity, or to provide a signal or signals indicative of other positions or velocities of the frame, including its angular position, velocity, or acceleration in a direction such as the direction of roll 104, pitch 108, yaw 112, or its linear acceleration in a longitudinal 102, latitudinal 106, and/or vertical 110 direction. Sensors may be configured to directly measure inclination, or for example to measure angular velocity and integrate to arrive at inclination, and may typically, e.g., be comprised of an inertial measurement unit (IMU) mounted on the main frame 140 and configured to provide for example a work machine inclination (slope) signal, or equivalent signals corresponding to the slope of the frame 140, as inputs to the controller 138. Such an IMU 144 may for example be in the form of a three-axis gyroscopic unit configured to detect changes in orientation of the sensor, and thus of the frame 140 to which it is fixed, relative to an initial orientation.

In other embodiments, the sensors may include a plurality of GPS sensing units (not shown) fixed relative to the main frame 140 or work implement 130, 162, which can detect the absolute position and orientation of the work machine 100 or components thereof within an external reference system, and can detect changes in such position and orientation.

A perception sensor 170 such as for example a stereo camera may be coupled to the work machine 100, for example at an elevated rear portion of the main frame 140 and arranged to provide a perception field 172 (e.g., corresponding to a field of view for a stereo camera as the perception sensor 170) encompassing at least a rear-mounted work implement 162 and objects proximate thereto. The perception sensor 170 is functionally linked to the controller 138 as further described herein for image processing features and steps. It may be appreciated that numerous addition perception sensors 170 and/or different types of perception sensors 170 may be utilized, as further described below.

The controller 138 in an embodiment (not shown) may include or may be associated with a processor, a computer readable medium, a communication unit, data storage 178 such as for example a database network, and the aforementioned user interface 142 or control panel having a display. An input/output device, such as a keyboard, joystick, touch screen, or other user interface tool, may be provided so that the human operator may input instructions to the controller 138. It is understood that the controller described herein may be a single controller having all of the described functionality, or it may include multiple controllers wherein the described functionality is distributed among the multiple controllers.

Various operations, steps or algorithms as described in connection with the controller 138 can be embodied directly in hardware, in a computer program product such as a software module executed by a processor, or in a combination of the two. The computer program product can reside in RAM memory, flash memory, ROM memory, EPROM memory, EEPROM memory, registers, hard disk, a removable disk, or any other form of computer-readable medium known in the art. An exemplary computer-readable medium can be coupled to the processor such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The communication unit may support or provide communications between the controller 138 and external systems or devices, and/or support or provide communication interface with respect to internal components of the work machine 100. The communications unit may include wireless communication system components (e.g., via cellular modem, WiFi, Bluetooth or the like) and/or may include one or more wired communications terminals such as universal serial bus ports.

Data storage 178 as discussed herein may, unless otherwise stated, generally encompass hardware such as volatile or non-volatile storage devices, drives, memory, or other storage media, as well as one or more databases residing thereon.

The work machine 100 is supported on the ground by an undercarriage 114. The undercarriage 114 includes ground engaging units 116, 118, which in the present example are formed by a left track 116 and a right track 118, and provide tractive force for the work machine 100. Each track may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of the work machine 100, provide support for the work machine 100 on the ground. Front idlers 120, track rollers 122, rear sprockets 124, and top idlers 126 are all pivotally connected to the remainder of the work machine 100 and rotationally coupled to their respective tracks so as to rotate with those tracks. The track frame 128 provides structural support or strength to these components and the remainder of the undercarriage 114. In alternative embodiments, the ground engaging units 116, 118 may comprise, e.g., wheels on the left and right sides of the work machine.

Front idlers 120 are positioned at the longitudinal front of the left track 116 and the right track 118 and provide a rotating surface for the tracks to rotate about and a support point to transfer force between the work machine 100 and the ground. The left and right tracks 116, 118 rotate about the front idlers 120 as they transition between their vertically lower and vertically upper portions parallel to the ground, so approximately half of the outer diameter of each of the front idlers 120 is engaged with the respective left 116 or right track 118. This engagement may be through a sprocket and pin arrangement, where pins included in the left 116 and right tracks 118 are engaged by recesses in the front idler 120 so as to transfer force. This engagement also results in the vertical height of the left and right tracks 116, 118 being only slightly larger than the outer diameter of each of the front idlers 120 at the longitudinal front of the tracks. Forward engaging points 130 of the tracks 116, 118 can be approximated as the point on each track vertically below the center of the front idlers 120, which is the forward point of the tracks which engages the ground.

Track rollers 122 are longitudinally positioned between the front idler 120 and the rear sprocket 124 along the bottom left and bottom right sides of the work machine 100. Each of the track rollers 122 may be rotationally coupled to the left track 116 or the right track 118 through engagement between an upper surface of the tracks and a lower surface of the track rollers 122. This configuration may allow the track rollers 122 to provide support to the work machine 100, and in particular may allow for the transfer of forces in the vertical direction between the work machine and the ground. This configuration also resists the upward deflection of the left and right tracks 116, 118 as they traverse an upward ground feature whose longitudinal length is less than the distance between the front idler 120 and the rear sprocket 124.

Rear sprockets 124 may be positioned at the longitudinal rear of each of the left track 116 and the right track 118 and, similar to the front idlers 120, provide a rotating surface for the tracks to rotate about and a support point to transfer force between the work machine 100 and the ground. The left and right tracks 116, 118 rotate about the rear sprockets as they transition between their vertically lower and vertically upper portions parallel to the ground, so approximately half of the outer diameter of each of the rear sprockets 124 is engaged with the respective left or right track 116, 118. This engagement may be through a sprocket and pin arrangement, where pins included in the left and right tracks are engaged by recesses in the rear sprockets 124 to transfer force. This engagement also results in the vertical heights of the tracks being only slightly larger than the outer diameter of each of the rear sprockets 124 at the longitudinal back or rear of the respective track. The rearmost engaging point of the tracks can be approximated as the point on each track vertically below the center of the rear sprockets, which is the rearmost point of the track which engages the ground. In this embodiment, each of the rear sprockets 124 may be powered by a rotationally coupled hydraulic motor so as to drive the left track 116 and the right track 118 and thereby control propulsion and traction for the work machine 100. Each of the left and right hydraulic motors may receive pressurized hydraulic fluid from a hydrostatic pump whose direction of flow and displacement controls the direction of rotation and speed of rotation for the left and right hydraulic motors. Each hydrostatic pump may be driven by an engine 134 (or equivalent power source) of the work machine and may be controlled by an operator in the operator cab 136 issuing commands which may be received by the controller 138 and communicated to the left and right hydrostatic pumps. In alternative embodiments, each of the rear sprockets may be driven by a rotationally coupled electric motor or a mechanical system transmitting power from the engine.

Top idlers 126 are longitudinally positioned between the front idlers 120 and the rear sprockets 124 along the left and right sides of the work machine 100 above the track rollers 122. Similar to the track rollers, each of the top idlers may be rotationally coupled to the left track 116 or the right track 118 through engagement between a lower surface of the tracks and an upper surface of the top idlers. This configuration may allow the top idlers to support the tracks for the longitudinal span between the front idler and the rear sprocket and prevent downward deflection of the upper portion of the tracks parallel to the ground between the front idler and the rear sprocket.

The blade assembly 130 as represented in the embodiment of FIG. 1 is a front-mounted work implement 130 which may engage the ground or material, for example to move material from one location to another and to create features on the ground, including flat areas, grades, hills, roads, or more complexly shaped features. The blade 130 is movably connected to the main frame 140 of the work machine 100 through a linkage 146 which supports and actuates the blade and is configured to allow the blade to be lifted (i.e., raised or lowered in the vertical direction 110) relative to the main frame. The linkage 146 includes a c-frame 148, a structural member with a C-shape positioned rearward of the blade 130, with the C-shape open toward the rear of the work machine 100. The blade 130 may be lifted (i.e., raised or lowered) relative to the work machine 100 by the actuation of lift cylinders 150, which may raise and lower the c-frame 148. The blade 130 may be tilted relative to the work machine 100 by the actuation of a tilt cylinder 152, which may also be referred to as moving the blade in the direction of roll 104. The blade 130 may be angled relative to the work machine 100 by the actuation of angle cylinders 154, which may also be referred to as moving the blade in the direction of yaw 112. Each of the lift cylinders 150, tilt cylinder 152, and angle cylinders 154 may for example be a double acting hydraulic cylinder.

The rear-mounted work implement 162 as represented in the embodiment of FIG. 1 is a ripper assembly which may selectively engage the ground or material, for example to loosen the ground behind the work machine 100. The rear-mounted work implement 162 as shown includes a plurality of (e.g., three) separate ripper shanks which are typically substantially perpendicular to the ground. When the ripper is not in use, the shanks may be raised so that they are not in contact with the ground, for example using one or more actuators which may be vary in form with respect to the actuators 170, 172, 174 for the front-mounted implement 130 but are equivalent in function for the purpose of directing movement (i.e., raising and lowering relative to the main frame 140). Alternatively, when the ripper is in use, the shanks may be lowered to penetrate the ground surface and thereby loosen the ground as the work machine proceeds.

Figure 2:
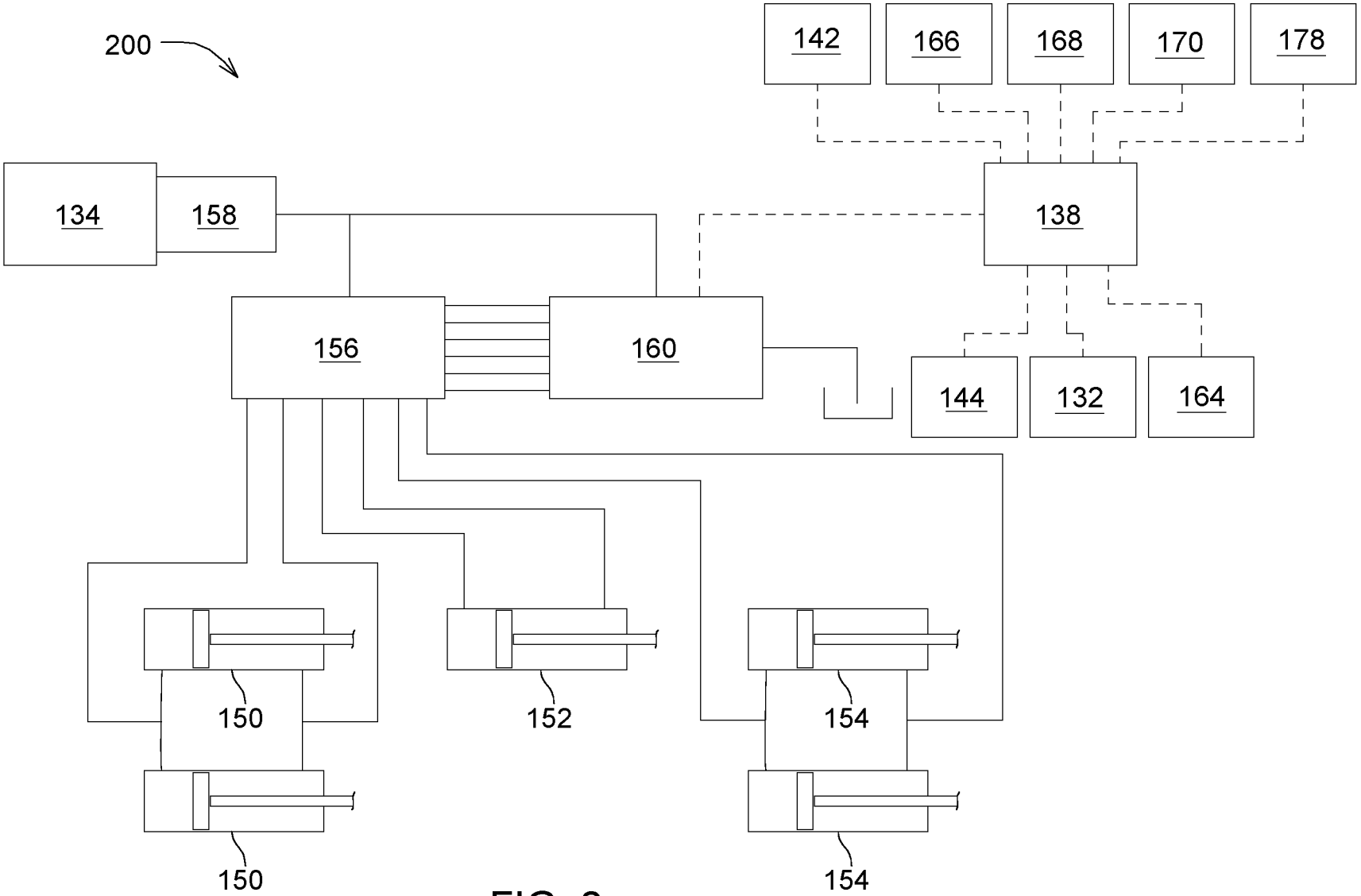
FIG. 2 is a block diagram representing an exemplary control system for the work machine according to an embodiment as disclosed herein.

As schematically illustrated in FIG. 2, the work machine 100 in an embodiment as disclosed herein includes a control system 180 including a controller 138. The controller 138 may be part of the machine control system of the work machine 100, or it may be a separate control module. The control system 200 may include hydraulic and electrical components for controlling respective positions of the front-mounted 130 and/or rear-mounted 162 work implements. For example with respect to the blade 130, each of the lift cylinders 150, the tilt cylinder 152, and the angle cylinders 154 is hydraulically connected to a hydraulic control valve 156, which receives pressurized hydraulic fluid from a hydraulic pump 158, which may be rotationally connected to the engine 134, and directs such fluid to the lift cylinders, the tilt cylinder, the angle cylinders, and other hydraulic circuits or functions of the work machine. The hydraulic control valve may meter such fluid out, or control the flow rate of hydraulic fluid to each hydraulic circuit to which it is connected. In alternative embodiments, the hydraulic control valve may not meter such fluid out but may instead only selectively provide flow paths to these functions while metering is performed by another component (e.g., a variable displacement hydraulic pump) or not performed at all. The hydraulic control valve may meter such fluid out through a plurality of spools, whose positions control the flow of hydraulic fluid, and other hydraulic logic. The spools may be actuated by solenoids, pilots (e.g., pressurized hydraulic fluid acting on the spool), the pressure upstream or downstream of the spool, or some combination of these and other elements.

In various embodiments, the controller 138 may send commands to actuate work implements 130, 162 in a number of different manners. As one example, the controller 138 may be in communication with a valve controller via a controlled area network (CAN) and may send command signals to the valve controller in the form of CAN messages. The valve controller may receive these messages from the controller and send current to specific solenoids within the electrohydraulic pilot valve 160 based on those messages. As another example, the controller 138 may actuate a work implement 130, 162 by actuating an input in the operator cab 136. For example, an operator may use a joystick to issue commands to actuate the blade 130, and the joystick may generate hydraulic pressure signals, pilots, which are communicated to the hydraulic control valve 156 to cause the actuation of the blade. In such a configuration, the controller 138 may be in communication with electrical devices (e.g., solenoids, motors) which may actuate a joystick in the operator cab. In this way, the controller 138 may actuate the blade by actuating these electrical devices instead of communicating signals to electrohydraulic pilot valve.

As referenced above, the controller 138 may be configured to receive input signals from some or all of various perception sensors 170. The perception sensors 170 may include video cameras configured to record an original image stream and transmit corresponding data to the controller 138. In the alternative or in addition, the perception sensors 170 may include one or more of an infrared camera, a stereoscopic camera, a PMD camera, high resolution light detection and ranging (LiDAR) scanners, radar detectors, laser scanners, and the like within the scope of the present disclosure. Corresponding outputs associated with a perception sensor 170 may accordingly relate to images of a perception field 172 (e.g., field of view), point clouds, reflectance/time-of flight data, etc. The number and orientation of perception sensors 170 may vary in accordance with the type of work machine 100 and relevant applications, but in the illustrated embodiment are provided with respect to a perception field 172 rearward of the work machine 100 and configured to capture image data associated with surroundings including for example the rear-mounted work implement 162 and other objects proximate thereto.

The position and size of a perception field 172 encompassed by a respective perception 170 may depend on the arrangement and orientation thereof. For example, the field of view for a video camera may depend on a type of the camera and the camera lens system, in particular the focal length of the lens of the camera. One of skill in the art may further appreciate that, e.g., image data processing functions may be performed discretely at a given perception sensor 170 if properly configured, but also or otherwise may generally include at least some image data processing by the controller 138 or other downstream data processor. For example, perception data from any one or more perception sensors 170 may be provided for three-dimensional point cloud generation, image segmentation, object delineation and classification, and the like, using image data processing tools as are known in the art in combination with the objectives disclosed.

The controller 138 of the work machine 100 may be configured to produce outputs, as further described below, to a user interface 142 associated with a display unit for display to the human operator. The controller 138 may be configured to receive inputs from the user interface 142, such as user input provided via the user interface 142. Not specifically represented in FIG. 2, the controller 138 of the work machine 100 may in some embodiments further receive inputs from and generate outputs to remote devices associated with a user via a respective user interface, for example a display unit with touchscreen interface. Data transmission, between for example the vehicle control system and a remote user interface, may take the form of a wireless communications system and associated components as are conventionally known in the art. In certain embodiments, a remote user interface and vehicle control systems for respective work machines may be further coordinated or otherwise interact with a remote server or other computing device for the performance of operations in a system as disclosed herein.

The controller 138 may in various embodiments, as part of the control system 180 of FIG. 2 and further in line with the above-referenced disclosure, be functionally linked to a reading device (not shown) as conventionally known in the art such as for example an RFID device, barcode scanner, or the like for obtaining readable information. The reading device may be a discrete device, or in other embodiments may include a data processing module in combination with image data or equivalent data captured by the sensor 170. For example, a work implement 130, 162 within a field of view 172 of a camera as the sensor 170 may have a barcode or equivalent tags (e.g., AprilTags) associated with machine readable information, which may as further described herein be used to identify and/or retrieve information associated with the work implement. As further described below, such information may for example relate to structural information obtained via a stored CAD file for reliably predicting pixels occupied by the work implement as it moves to various discrete positions through a perception field.

In various embodiments, the controller may be functionally linked to one or more audio output devices 166, configured to emit a defined audio signal internally or externally with respect to the work machine 100. One or more audio signals may be defined and emitted as corresponding to respective alert conditions, such as for example with respect to a proximity and/or criticality of detected objects in the work area.

In an embodiment as shown, the controller 138 may further be functionally linked to a work machine movement control system 168, wherein for example the controller may directly or indirectly generate output signals for controlling the steering and/or advance speed of the work machine 100. The controller 138 may alternatively or in addition receive input signals from the movement control system 168 indicative of the steering and/or advance speed of the work machine 100.

The controller 138 is generally described herein as performing various functions, including for example steps and operations as further described below with respect to exemplary methods, but it should be noted that in various embodiments at least some of the steps and operations may be performed by one or more processors separate from the controller 138. For example, one or more processor associated with a mobile user computing device, and/or a remote server network, may be utilized alone or in combination with the controller 138 to perform steps and operations as disclosed herein, unless otherwise specifically noted.

Figure 3:
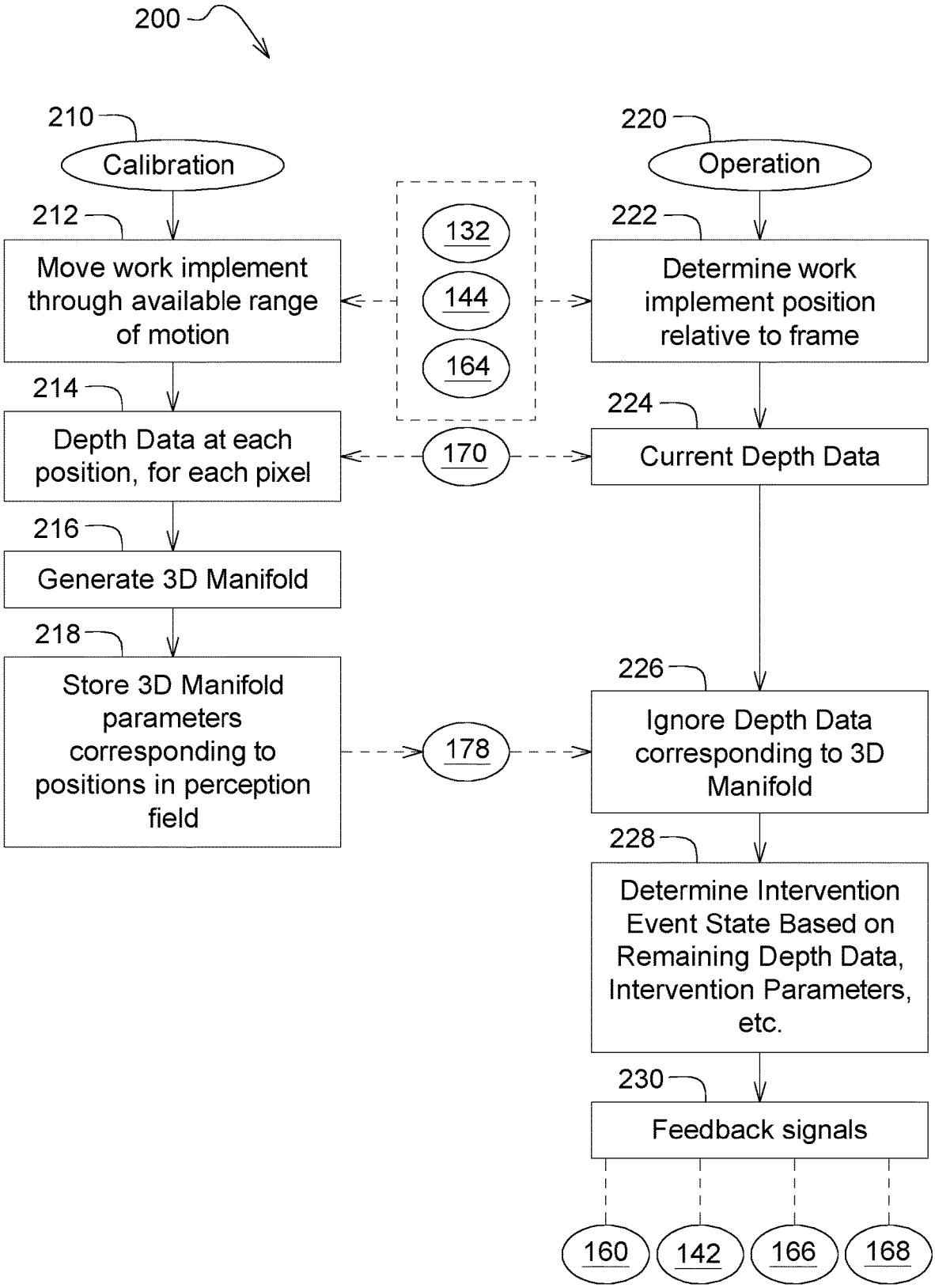
FIG. 3 is a flowchart representing an exemplary embodiment of a method as disclosed herein.

An embodiment of a method 200 of the present disclosure may now be described with further illustrative reference to FIGS. 3-5. The present embodiment is intended as illustrative and the associated description is not limiting on the scope of any other embodiments unless otherwise specifically noted herein.

It should also be noted that various steps as disclosed in accordance with the present embodiment may be combined, omitted, or supplemented by one of skill in the art when considering the applicable functions and without necessarily altering the scope of the present disclosure, unless otherwise expressly provided herein.

For example, the exemplary method 200 as illustrated in FIG. 2 includes a calibration stage 210 and an operating stage 220. In various embodiments, a method 200 as disclosed herein may begin with a calibration having already been performed, or with one or more steps being unnecessary based for example on available and selectively retrievable information corresponding to the work implement at issue and describing a structure thereof at relevant discrete operating positions.

In the embodiment shown, the calibration phase 210 of the method 200 begins in step 212 within movement of the work implement (e.g., a rear-mounted work implement such as a ripper) through its available range of movement relative to the main frame of the work machine, for example raising the work implement from a minimum height to a maximum height, lowering the work implement from a maximum height to a minimum height, or incorporating other movements as relevant to the respective type of implement.

The work implement may for example be moved to a plurality of discrete positions throughout the available range of movement, wherein further data may be captured as described below for each discrete position. Alternatively, the work implement may for example be moved continuously throughout the available range of movement and further data captured as described below with respect to discrete positions which are detected during movement of the work implement. As a still further alternative, the work implement may for example be moved continuously throughout the available range of movement, wherein further data may be captured as described below at various intervals and associated with detected discrete positions of the work implement. Various further alternative techniques may be appreciated as being within the scope of the present disclosure for effectively capturing further data (e.g., depth data) throughout the range of motion and corresponding to respective discrete positions of the work implement there within.

The calibration phase 210 of the illustrated method 200 may further include determining, via input from at least the one or more perception sensors while the work implement is being moved through step 212, and accordingly with respect to each of a plurality of associated discrete positions, depth data for each of a plurality of perception field portions with respect to objects identified within the perception field (step 214). In the described embodiment using a rear-mounted work implement and perception sensor, the relevant perception field comprises surroundings at least to the rear of the work machine.

The calibration phase 210 of the illustrated method 200 may further include, for each of the plurality of discrete positions, and based at least in part on identified pixels where changes in the depth data are occurring with sequential discrete positions of the work implement, generating a multidimensional (e.g., 3D) manifold (step 216) and storing the generated 3D manifold in data storage (step 218). In embodiments, the manifold is a 3D manifold comprising depth data associated with the work implement for the plurality of perception field portions including the work implement.

As noted above, changes in depth data at a corresponding portion (e.g., pixel location) in the perception field during the calibration procedure may generally be attributed to the work implement being moved into (or out of) that respective pixel location. Each identified pixel may accordingly be characterized as an individual work implement position sensor. For each discrete position of the work implement within the full available range of motion, values may be stored for each pixel sensor in, e.g., a lookup table. Additionally, for each discrete position of the work implement within the full available range of motion, the depth value of each pixel associated with the work implement is stored within a mask where the mask now represents a 3D manifold surrounding the work implement.

The discrete positions of the work implement as it is moved across the full range of motion may be determined using position sensors, such as for example an encoder or an IMU on the control arm of the work implement, to create a lookup table of associated work implement pixel sensor values and sensor output.

For example, if a sensed depth dramatically increases from one change in position to the next, the work implement may be assumed to have left that pixel location such that an object farther away from the sensor is now being captured. On the other hand, if a sensed depth dramatically decreases from one change in position to the next, the work implement may be assumed to have entered that pixel location. In some cases, less dramatic changes in depth data may result from movement of objects at a distance from the work machine which may be programmatically disregarded as not reasonably relating to the work implement. Preferably, during the calibration phase no movement takes place near to the work machine by elements other than the work implement at issue. An array of depth data for each position along the range of available movement may accordingly represent physical contours of the work implement, around which a multidimensional manifold may be generated.

Figure 4:
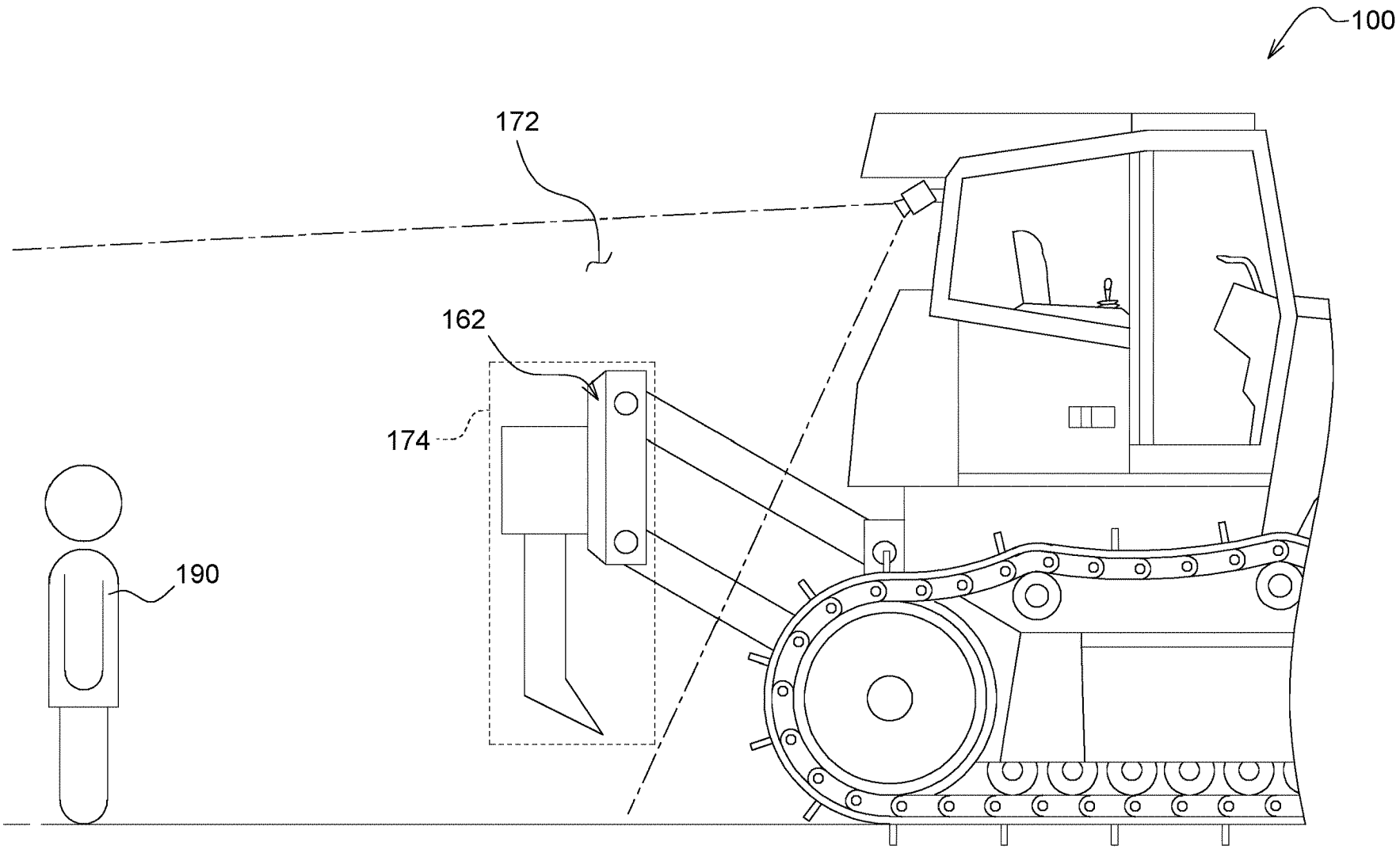
FIG. 4 is a side view representing an exemplary work machine and perception field, including a human standing behind a rear-mounted work implement.
Figure 5:
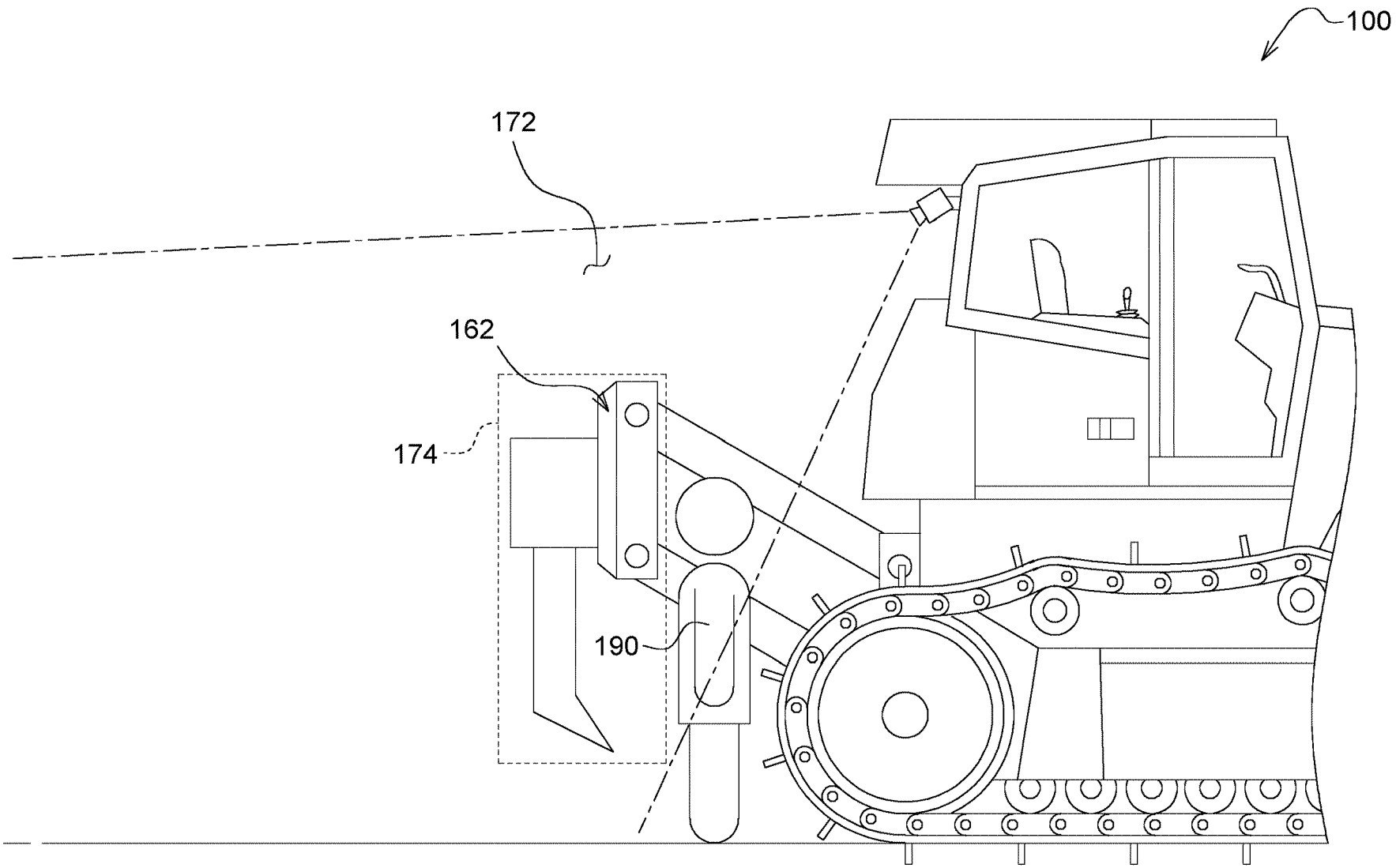
FIG. 5 is a side view representing an exemplary tracked work machine and perception field, including a human between a rear-mounted work implement and the machine tracks.

In various embodiments, as illustrated for example in FIGS. 4 and 5, the manifold 174 may be a relatively simple three-dimensional polyhedron, or in other embodiments may include any number of sides, angles, curved faces, or the like as better or more precisely corresponding with the actual contours of the work implement. In certain embodiments wherein the perspective is substantially horizontal or substantially vertical in orientation (e.g., a bird's eye view) the 3D manifold may be a relatively simple two-dimensional polygon, or may include any number of sides, angles, curved faces, or the like as better or more precisely corresponding with the actual contours of the work implement.

In an embodiment, the multidimensional manifold may be generated for at least a first position, for example a position at an extreme (e.g., a minimum or maximum) height with respect to the available range of movement, using a stored CAD model or the equivalent for specifying a structure for the work implement. With the structural information in hand, and assuming that the structure of the work implement remains fixed for the duration of the movement through the available range of movement, a multidimensional manifold may be generated for each subsequent discrete position after the first position depth.

In an embodiment, values may further be predicted for one or more perception field portions (e.g., pixels) as corresponding to the work implement, wherein the stored model may accordingly be verified at the subsequent positions based on captured depth values at the respective one or more perception field portions.

In various embodiments, the stored structural model or equivalent information regarding physical contours of the work implement may be referenced in one or more of numerous forms. In one example, machine readable tags such as for example AprilTags, RFID tags, and the like may be provided on the work implement itself, such that scanning of the tags enables simple retrieval of the associated information (e.g., a type of work implement or more specific information regarding the unique implement itself) by the controller. In another example, conventional image classification techniques may be utilized to roughly determine at least some representative features of the work implement and match the representative features to a library of work implement features.

The operation phase 220 of the illustrated method 200 may include, during a machine operation stage, determining, via input from associated position sensors, a current position of the relevant work implement relative to the main frame of the work machine (step 222), and further determining, via input from at least the one or more perception sensors, current depth data for each of a plurality of perception field portions with respect to objects identified within the perception field (step 224).

The operation phase 220 of the illustrated method 200 may further include processing the current depth data to ignore or otherwise cancel depth data corresponding to the work implement, at least in part by analyzing the stored 3D manifold to determine such depth data based on the current position of the work implement (step 226). For example, during the operation phase 220 algorithms associated with a system and method as disclosed herein may recursively fit the work implement pixel sensor values to a discrete position within the stored lookup table. With the position of the work implement known, the multidimensional manifold for that position can then be used to ignore or mask all pixels which fall within the area surrounding or otherwise corresponding to the work implement at that position.

In an embodiment, as represented in FIG. 4, an object 190 (a human in the present example) is standing in the perception field 172 of a rear-mounted perception sensor 170, behind the rear-mounted work implement 162. A 3D manifold 174 is generated about the work implement 162 to enable separation of the object 190 from the work implement 162 in a straightforward manner and such that no alerts are generated based on detection of the work implement alone.

As represented in FIG. 5, however, the object 190 is still in the perception field 172 of the perception sensor 170 but is now present between the work implement 162 and the main frame 140 of the work machine 100. If the 3D manifold 174 were not specifically defined with respect to the structural contours of the work implement 162, appropriate separation of the object 190 may not be possible. Accordingly, having previously calibrated the system to determine specific structural details of the work implement for each position thereof, a more precisely defined 3D manifold 174 is generated and utilized, wherein an object 190 in close proximity to the work machine 100 may be reliably separated and identified by elements of the system.

The operation phase 220 of the illustrated method 200 may further include determining an intervention event state based on the objects identified within the perception field, further having disregarded any objects identified as corresponding to the multidimensional manifold corresponding to the current position of the work implement (step 228)

The operation phase 220 of the illustrated method 200 may further include conditionally generating feedback signals corresponding to the determined intervention event state (step 230). An intervention event state may be determined based on factors including for example a detected distance to an object, a travel speed of the work machine, a work state of the work vehicle, and the like. For example, while the current travel speed and trajectory of the work machine may otherwise indicate a potential for collision with the detected object in a period of time that would otherwise result in a first intervention event state, e.g., corresponding to an operator alert, the controller may determine that the current travel speed and/or trajectory will not be maintained based on a current work state, and therefore at least provisionally determine a second intervention event state, e.g., not mandating an operator alert.

In various embodiments the controller 220 may make this determination based on predetermined rules, such that for example the thresholds are fixed with respect to different work states, or the controller 220 may learn correlations over time between the determined work state and patterns of travel for the work vehicle which leads to confidence in the predicted movements of the work vehicle and associated work implement. This may for example avoid false positives with respect to generated visual and audio alerts.

In an embodiment, the feedback signals in step 230 may be provided in accordance with at least one intervention event state to the work machine controller for automatically controlling one or more components 160, 168 of the work machine to avoid one or more of the objects identified within the perception field. For example, the controller 138 in association with a particular intervention state may generate control signals for work machine steering control, work implement position control, work machine propulsion control, or the like for automatically steering away from a detected object, automatically braking to avoid colliding with the detected object, etc. In an embodiment, automated control features may be implemented after a predetermined window after an initial alert is generated, wherein the operator or other user associated with the work vehicle has an opportunity to react to the alert but has not yet acted, but before a threshold which may correspond to a necessary amount of time for reacting to the detected object (e.g., a calculated stopping time, calculated stopping distance, predicted movement of the detected object, etc., further possibly accounting for determined work conditions).

In an embodiment, which may for example overlap with other described embodiments relating to the feedback signals, the feedback signals in step 230 may be provided in accordance with at least one intervention event state to generate audio and/or visual alerts via user interface 142 and/or audio output device 166 based at least in part on a spatial proximity of one or more of the objects identified within the perception field with respect to the work machine.

In various embodiments, intervention alert states may be triggered according to violations of specified settings (e.g., thresholds), optionally further in view of operating parameters such as a work machine travel speed, distance to the object at issue, type of work operation, movement of the work implement (e.g., observed, intended, or predicted), a classified type of object (e.g., human, static non-human object, moving non-human object), etc. For example, if an object is recognized as being in a dangerous location relative to a position of the work implement, or otherwise in view of a predicted movement of the work machine and/or work implement, an alert may be generated in the form of an audio alarm, a visual alert on the display unit, or the like.

The type of alert may be dependent at least in part on the type of object, wherein for example a living creature as a first type of differentiated object in the field of view may result in a first and more urgent form of alert whereas a second type of differentiated object in the form of for example debris may result in a second and less urgent form of alert. In some embodiments this determination may be made in view of the above-referenced object detection and/or recognition function, further in view of a machine geometry or pose detection function which determines if the work implement 162 is in a position or orientation corresponding with for example a first work state (i.e., at rest and therefore of reduced risk to a proximate object) or a second work state (i.e., an active state and therefore of potentially heightened risk to a proximate object).

Alert functions may be generated in certain embodiments in association with a predetermined threshold for a given work implement 162, a variable threshold depending on a work state or condition of the given work implement 162, and/or a non-threshold determination made further in view of factors including for example a detected movement of the object(s), detected movement of the work implement 162, predicted movements of the object(s) and/or work implement 162, type of terrain being traversed by the work machine 100, orientation of the work machine 100, and the like.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item B and item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method of generating intervention feedback based on objects in a work area with a work machine, the work machine having one or more perception sensors and a work implement associated therewith, the work implement having an available range of movement relative to a frame of the work machine which at least partially extends into a perception field associated with the one or more perception sensors, the method comprising:

during a calibration stage:

causing the work implement to be moved to a plurality of positions corresponding to the available range of movement;

determining, via input from at least the one or more perception sensors, and with respect to each of the plurality of positions, depth data for each of a plurality of perception field portions with respect to objects identified within the perception field;

for each of the plurality of positions, based at least in part on identified changes in the depth data occurring at perception field portions as the work implement moves into or out of respective field portions with sequential positions of the work implement, generating a multidimensional manifold in data storage comprising depth data associated with the work implement for the plurality of perception field portions including the work implement and storing a retrievable table correlating position sensor outputs with the depth data for each of the plurality of positions; and during a machine operation stage:

determining, via input from at least the one or more perception sensors, current depth data for each of a plurality of perception field portions with respect to objects identified within the perception field;

determining an intervention event state based on the objects identified within the perception field, further disregarding any objects identified as corresponding to the multidimensional manifold corresponding to a current position of the work implement;

conditionally generating feedback signals corresponding to the determined intervention event state.

2. The method of claim 1, wherein the feedback signals are provided in accordance with at least one intervention event state to a work machine controller for controlling one or more components of the work machine to avoid one or more of the objects identified within the perception field.

3. The method of claim 1, wherein the feedback signals are provided in accordance with at least one intervention event state to generate audio and/or visual alerts based at least in part on a spatial proximity of one or more of the objects identified within the perception field with respect to the work machine.

4. The method of claim 1, wherein at least one intervention alert state is triggered by at least one of the one or more objects being nearer to the frame of the work machine than the work implement within a common perception field portion.

5. The method of claim 1, wherein at least one intervention alert state is triggered by at least one of the one or more objects being within a corresponding threshold.

6. The method of claim 5, wherein a plurality of intervention alert states are respectively dependent on a travel speed of the work machine and a distance separating the at least one of the one or more objects from the work machine and/or work implement.

7. The method of claim 1, wherein each of the perception field portions correspond to respective pixels in a field of view for a perception sensor.

8. The method of claim 1, wherein the multidimensional manifold is generated for at least a first of the plurality of positions using a stored model specifying a structure for the work implement.

9. The method of claim 8, wherein the calibration state comprises, for each subsequent position after the first position, predicting depth values for one or more perception field portions as corresponding to the work implement, and verifying the stored model based on captured depth values at the respective one or more perception field portions.

10. A work machine configured to generate intervention feedback based on objects in a work area, the work machine comprising:

one or more perception sensors;

a work implement having an available range of movement relative to a frame of the work machine which at least partially extends into a perception field associated with the one or more perception sensors; and one or more processors functionally linked to the one or more perception sensors and one or more actuators associated with the work implement, and configured to, during a calibration stage:

cause the work implement to be moved to a plurality of positions corresponding to the available range of movement;

determine, via input from at least the one or more perception sensors, and with respect to each of the plurality of positions, depth data for each of a plurality of perception field portions with respect to objects identified within the perception field; and for each of the plurality of positions, based at least in part on identified changes in the depth data occurring at perception field portions as the work implement moves into or out of respective field portions with sequential positions of the work implement, to generate a multidimensional manifold in data storage comprising depth data associated with the work implement for the plurality of perception field portions including the work implement and storing a retrievable table correlating position sensor outputs with the depth data for each of the plurality of positions;

wherein the one or more processors are further configured to, during a machine operation stage:

determine, via input from at least the one or more perception sensors, current depth data for each of a plurality of perception field portions with respect to objects identified within the perception field;

determine an intervention event state based on the objects identified within the perception field, further disregarding any objects identified as corresponding to the multidimensional manifold corresponding to a current position of the work implement; and conditionally generate feedback signals corresponding to the determined intervention event state.

11. The work machine of claim 10, comprising one or more position sensors mounted in association with the work implement and/or an actuator thereof, wherein the data storage comprises a retrievable table correlating position sensor outputs corresponding to work implement positions with depth values from the one or more perception sensors.

12. The work machine of claim 10, wherein the one or more perception sensors comprise at least one perception sensor having a field of view comprising a plurality of pixels corresponding to the plurality of perception field portions, and the depth data is generated based at least in part on outputs from at least one other perception sensor.

13. The work machine of claim 10, wherein the feedback signals are provided in accordance with at least one intervention event state to a work machine controller, wherein the controller is configured to generate control signals for controlling one or more components of the work machine to avoid one or more of the objects identified within the perception field.

14. The work machine of claim 10, wherein the feedback signals are provided in accordance with at least one intervention event state to generate audio and/or visual alerts based at least in part on a spatial proximity of one or more of the objects identified within the perception field with respect to the work machine.

15. The work machine of claim 10, wherein at least one intervention alert state is triggered by at least one of the one or more objects being nearer to the frame of the work machine than the work implement within a common perception field portion.

16. The work machine of claim 10, wherein at least one intervention alert state is triggered by at least one of the one or more objects being within a corresponding threshold.

17. The work machine of claim 16, wherein a plurality of intervention alert states are respectively dependent on a travel speed of the work machine and a distance separating the at least one of the one or more objects from the work machine and/or work implement.

18. The work machine of claim 10, wherein each of the perception field portions correspond to respective pixels in a field of view for a perception sensor.

19. The work machine of claim 10, wherein the multidimensional manifold is generated for at least a first of the plurality of positions using a stored model specifying a structure for the work implement.

20. The work machine of claim 19, wherein the one or more processors are configured, during the calibration state and for each subsequent position after the first position, to predict depth values for one or more perception field portions as corresponding to the work implement, and verify the stored model based on captured depth values at the respective one or more perception field portions.

* * * * *